United States Patent [19]

Pilesi et al.

[11] 4,196,811

[45] Apr. 8, 1980

[54] METHOD AND APPARATUS FOR THE INSPECTION OF BUTTONS

[75] Inventors: William D. Pilesi, Monroeville; Andrew Wowczuk, Pittsburgh, both of Pa.

[73] Assignee: Koppers Company, Inc., Pittsburgh, Pa.

[21] Appl. No.: 830,696

[22] Filed: Sep. 6, 1977

[51] Int. Cl.[2] ..... B07C 5/342

[52] U.S. Cl. ..... 209/588; 250/223 R; 356/239; 209/939

[58] Field of Search ..... 209/111.5, 111.6, 111.7 R, 209/111.7 T, 71, 72, 73, 74 R, 75, 552, 576, 577, 588; 198/461; 250/223 R, 229; 356/239, 168; 112/113

[56] References Cited

U.S. PATENT DOCUMENTS

| | | | |
|---|---|---|---|
| 2,063,485 | 12/1936 | Carris | 209/111.6 |
| 2,351,702 | 6/1944 | Peterson | 209/111.7 T |
| 3,056,032 | 9/1962 | Cannon | 250/563 |
| 3,521,749 | 7/1970 | Dijstelbergen et al. | 209/111.7 T X |
| 4,044,891 | 8/1977 | Pynsky | 209/73 |

*Primary Examiner*—Joseph J. Rolla
*Assistant Examiner*—Edward M. Wacyra
*Attorney, Agent, or Firm*—Thomas L. Sivak; Oscar B. Brumback

[57] ABSTRACT

A method and apparatus for inspecting and sorting buttons and the like. The buttons to be inspected are fed to a velocity control system which imparts a uniform velocity to each button and propels it between a light source and detector. The light from the source is controlled by a mask to limit the light to the central zone of the button. The amount of light which passes through the central zone of the button is then converted to an electrical signal by the detector electronics. The electrical signal is then compared to pre-set upper and lower limits. If the signal falls within the pre-set limits, an accept signal is generated which is used to control a reject mechanism for automatic separation of buttons for collection and use.

18 Claims, 10 Drawing Figures

METHOD AND APPARATUS FOR THE INSPECTION OF BUTTONS

BACKGROUND OF THE INVENTION

1. Field of Invention

This invention relates to the inspection of geometrically symmetrical stable units such as buttons and particularly to the inspection of the central zone of buttons for manufacturing defects.

2. Description of the Prior Art

When buttons are manufactured, threadholes or eyes are placed in the central zone of the button. Not all of the holes or eyes are perfectly formed. Sometimes a hole may be plugged with a flash or web of material; the holes may be improperly spaced or may be entirely missing. Buttons with such defects are unacceptable for use on garments. In addition, since the buttons are fastened to the garments by automatic machinery these defects can cause a breakdown in the button-fastening machinery resulting in downtime of the machinery causing a loss of productivity. In order to avoid these losses, button manufacturers have had to inspect the buttons after manufacture.

Generally the buttons are inspected manually by a group of workers who watch the buttons pass on a moving conveyor. If a defective button is spotted, it is manually lifted from the conveyor. This work is necessarily very tedious. Not only is it tedious but it is also expensive in terms of time and money and due to the very nature of the work it is very inefficient.

Various schemes to automatically inspect buttons have been proposed, such as that shown in U.S. Pat. No. 3,956,636. A button inspecting system employing laser technology and computers has been proposed. While such a method could conceivably provide a reliable inspection, the cost of the lasers and the maintenance of the computers has made such a system of doubtful commercial practicality. Notwithstanding these various proposals to automate the inspection, today the manual method of inspection is widely employed.

Accordingly, it is an object of the present invention to provide a highly reliable and efficient method and apparatus for the inspection in sorting of buttons. It is a further object of this invention to provide a relatively inexpensive method and apparatus for the inspection and sorting of buttons.

SUMMARY OF THE INVENTION

In the present invention, light is passed through the button to a receptor where the quantity of light is integrated and compared with a standard. Depending upon the result of this comparison, a button is selectively accepted or rejected. To this end buttons are fed from a vibratory feeder to a chute designed to dampen the vibration caused by the vibrating feeder. In a preferred embodiment a space is maintained between the chute and the vibratory feeder to further minimize the vibration and to provide faster transition of the button to the spring chute.

The chute is attached to the surface of the velocity control system. The chute terminates in adjustable guides which are attached to the surface. A suitable attachment is made of the chute and side guides to prevent the buttons from lifting when they contact the surface. The side guides are parallel and extend past the velocity wheels and detector. The side guides for the buttons terminate approximately ½ inch before the air reject valve and the spacing between the guides can be varied to accommodate various size buttons. The surface is made of metal and includes a transparent insert, such as glass, which extends the entire length of travel of the buttons on the surface. The insert helps reduce friction. Mounted beneath the transparent insert is a variable diameter iris. The variable iris is used to limit the area of the light beam from the source so as to restrict the light to pass through only the central zone of the button. The surface of the velocity control system is inclined at a minimum angle from the horizontal and can be varied for different button requirements.

The velocity control system includes a plurality of velocity wheels which impart a uniform velocity to each button and cause a spacial separation between buttons. The wheels, which are spaced apart, are made from metal covered with an elastomeric material. Each wheel is hung from an adjustable hanger support system fixed to the surface of the velocity control system to be changed to accommodate buttons of various thickness. In order for the proper velocity to be imparted to the button, the elastomeric material of the wheels must be slightly compressed when a button is contacted. Therefore, the clearance between the wheel and the surface of the velocity control system must be set for buttons of various thicknesses.

Each velocity control wheel is driven by a motor by means of a shaft and idler. Each wheel imparts the uniform velocity to each button and causes the spacial separation between each button so the buttons slide over the glass insert, between the side guides and top cover past the light source and detector to the reject mechanism.

The light source is mounted below the surface of the velocity control system so as to permit the beam to pass through the glass insert therein. The source is a commercially available light emitting diode, LED. The light can be modulated to eliminate background effects from the environment. If the central hole zone of a button is being inspected, the area of the light beam is controlled by a variable diameter iris so that it passes only through the hole zone. The aperture of the iris is set for various diameter buttons. The iris opening is adjusted by a linkage mechanism to accurately set the amount of opening and to prevent the iris from changing its setting after a position is selected.

The detector-sensor is a PIN 10 D photo diode which is housed behind a spectral filter to eliminate ambient light. The light input received by the detector-sensor, which is the light which has passed through the central zone of the button, is converted to a voltage by the integrated circuitry of the detector-sensor. The signal is then amplified by a variable gain amplifier and demodulated by low pass filters. The decrease in light reaching the detector-sensor and the consequent decrease in voltage of the signal caused by the intrusion of a button into the light beam causes two pulse generators to be triggered. The first pulse generator causes the automatic gain control to be locked out and prevented from correcting the LED. The second pulse generator selects a portion of the signal to be integrated. The integrated signal is an input to the Digital Panel Meter and to a dual operational amplifier comparator, discriminator.

The upper and lower limits for an acceptable signal are set by potentiometers located on the front of the housing for the detector electronics. The upper and lower limits are set on the potentiometer by testing a selected series of good and bad buttons. If a good button has passed through the light beam, the value of the integrated signal will be between the upper and lower limits selected. The values are compared by a dual operational amplifier comparator and a high positive voltage output results for a good button. A low voltage results if a bad button passes.

The voltage output of the dual comparator is changed to a digital logic signal suitable for TTL integrated circuits. The reject circuit conditions the signals to a 5 volt and 0 volt pulse which is used to control the reject valve. The control circuit for the reject valve can be made to deflect either defective or acceptable buttons by changing the position of a selector switch in the circuit. Inspected buttons which are not deflected by the reject air jet, continue in a straight line into a collection area.

The foregoing provides a reliable and efficient method and apparatus for automatically inspecting buttons.

DESCRIPTION OF THE PREFERRED EMBODIMENT

Figure 2:
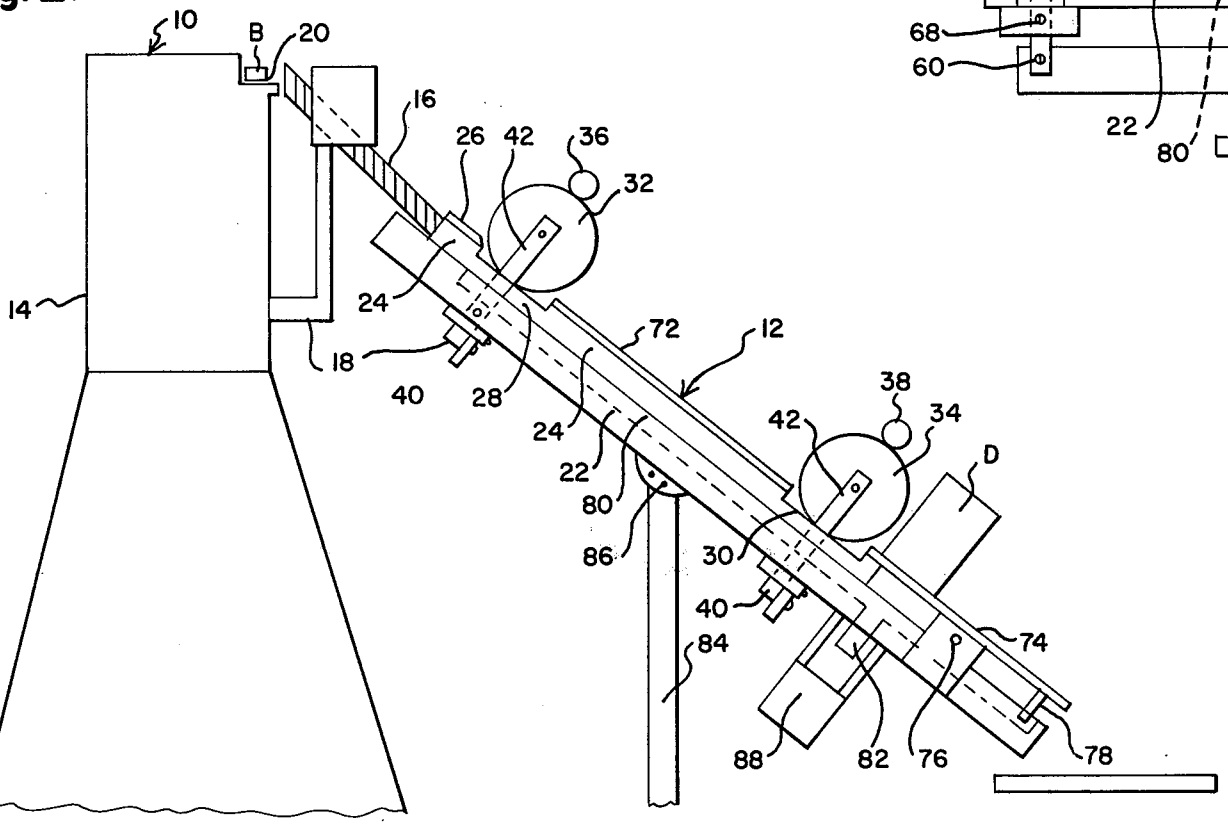
FIG. 2 is a side elevational view of the velocity control system of the present invention.

Referring to the drawings, FIG. 2 shows the button delivery system 10 and the velocity control system 12 of the present invention. The button delivery system 10 is a variable flow vibratory feeder 14 which is a commercially available apparatus. The delivery system includes a chute 16 made of steel spring wire having a diameter of 0.067 inch and that is rectangular in cross-section. Chute 16 is attached to the base of feeder 14 by means of a conventional hanger bracket 18 which is fixed to the base of the feeder and to the chute by means well known in the art. A gap of approximately 0.067 inch between the outlet chute 20 of feeder 14 and chute 16 in this preferred embodiment further prevents the transmission of the vibration of the feeder to the chute. Feeder 14 feeds the buttons B to be inspected individually and consecutively into chute 16. The feed rate of the buttons in the preferred embodiment illustrated herein is approximately 8 to 10 buttons per second.

Chute 16 extends to the inclined surface 22 of the velocity control system 12 whose surface 22 can be made of any suitable metal, aluminum being the metal for the preferred embodiment. Chute 16 terminates within adjustable side guides 24 of surface 22. At the end of chute 16 a plastic cover 26 extends over side guides 24 to prevent the buttons from lifting from contact with surface 22. Cover 26 can be fixed to side guides 24 by any number of conventional means.

Guides 24 which may be made of metal are fixed to surface 22 by suitable means such as screws passing through slots in surface 22 (not shown). The guides 24 have indent portions 28 and 30 immediately below the two velocity control wheels 32, 34. Indent portions 28 and 30 in the embodiment shown are approximately 0.080 inch high to allow the velocity control wheels to frictionally engage the upper flat surface of the buttons being tested. The remaining portion of guides 24 is higher than the buttons. Securing guides 24 to surface 22 by screws passing through slots in surface 22 has the advantage that the spacing between the guides can be varied to accommodate buttons of various diameters. For a button of ligne size 19 which has an outside diameter of 0.474 to 0.482 inch the width of the guides at the upper end of surface 22 would be approximately 0.488 inch. The guides remain parallel throughout their lengths. Generally, the desirable spacing between the guides should be 0.01 greater than the average outside diameter of the particular ligne size to be tested. While the movable guides are preferably fixed to surface 22 by means of screws, one skilled in the art will perceive that the guides can be fixed into a series of preset grooves for buttons of various diameters.

Velocity control wheels 32 and 34 as illustrated herein are approximately 6 inches apart, are made of aluminum coated with polyurethane with a surface hardness of approximately 50 durameters, are 3.0 inches in diameter, and are driven by idlers 36 and 38 by means of directly connected 1800 r.p.m. synchronous motors. Idler 36 has a diameter of 0.675 inch and reduces the r.p.m. of wheel 32 to 450; idler 38 has a diameter of 0.91 inch and reduces the r.p.m. of wheel 34 to 550; and both idlers are preferably made of stainless steel.

Wheels 32 and 34 are both fixed to surface 22 by means of adjustable hangers 40. Each hanger 40 includes two vertical supports 42 and 44, shaft housings 46 and 48 and axle 56. Supports 42 and 44 extend through bases 52 and 54 which are fitted in holes 56 and 58 in surface 22. Supports 42 and 44 are free to move vertically with respect to bases 52 and 54. The ends of the supports extending below bases 52 and 54 are fixed by means of screws 60 and 62 to cross-member 64. Adjustment screw 66 extends through member 64 and contacts the lower face of surface 22. Screws 68 and 70 extend through the lower portion of bases 52 and 54 and are adapted to engage supports 42 and 44 to stop vertical movement thereof when the wheels are at a predetermined height from surface 22. Each wheel 32 and 34 is mounted to the axle 56 of its hanger in a conventional manner by means of a bearing 39.

By means of adjustment screw 66 and screws 68 and 70, wheels 32 and 34 can be set at a predetermined height above surface 22. By rotation of screw 66, supports 42 and 44, and consequently axle 56, can be raised or lowered and that height maintained by setting screws 68 and 70 in contact with the supports. By setting wheels 32 and 34 to the proper height, sufficient contact between the button and wheels is assured so that a uniform velocity is imparted to the buttons. For example, a button of ligne size 19 with a finished thickness of approximately 0.097 inch, the height of the wheels above the surface 22 would be 0.089 inch and for a ligne size F14 button having a finished thickness of approximately 0.093 inch, the height of the wheels above surface 22 would be 0.085 inch.

Cover 72 extends the width of guides 24 from the downstream end of indent 28 to the upstream end of indent 30. Cover 74 extends from downstream of wheel 34 past the reject valve 76 of the reject mechanism and is supported by bracket 78 at the downstream end of surface 22. Reject valve 76 is a commercially available high speed solenoid valve which is controlled by the reject electronics. Both covers are transparent and in the illustrated embodiment are approximately 0.125 inch thick, and can be fixed to guides 24 in any conventional manner. If desired, the detector housing D can be used to compress the covers against the guides and clamp 78.

Surface 22 includes a glass insert 80 which extends the length of the surface beyond the variable iris 82, and which reduces friction and thereby provides a better path of travel for the buttons. Velocity control system 12 can be supported by leg 84. Leg 84 is telescopic and has a pivot point 86 to allow adjustment of the slope of the velocity control system 12.

Figure 4:
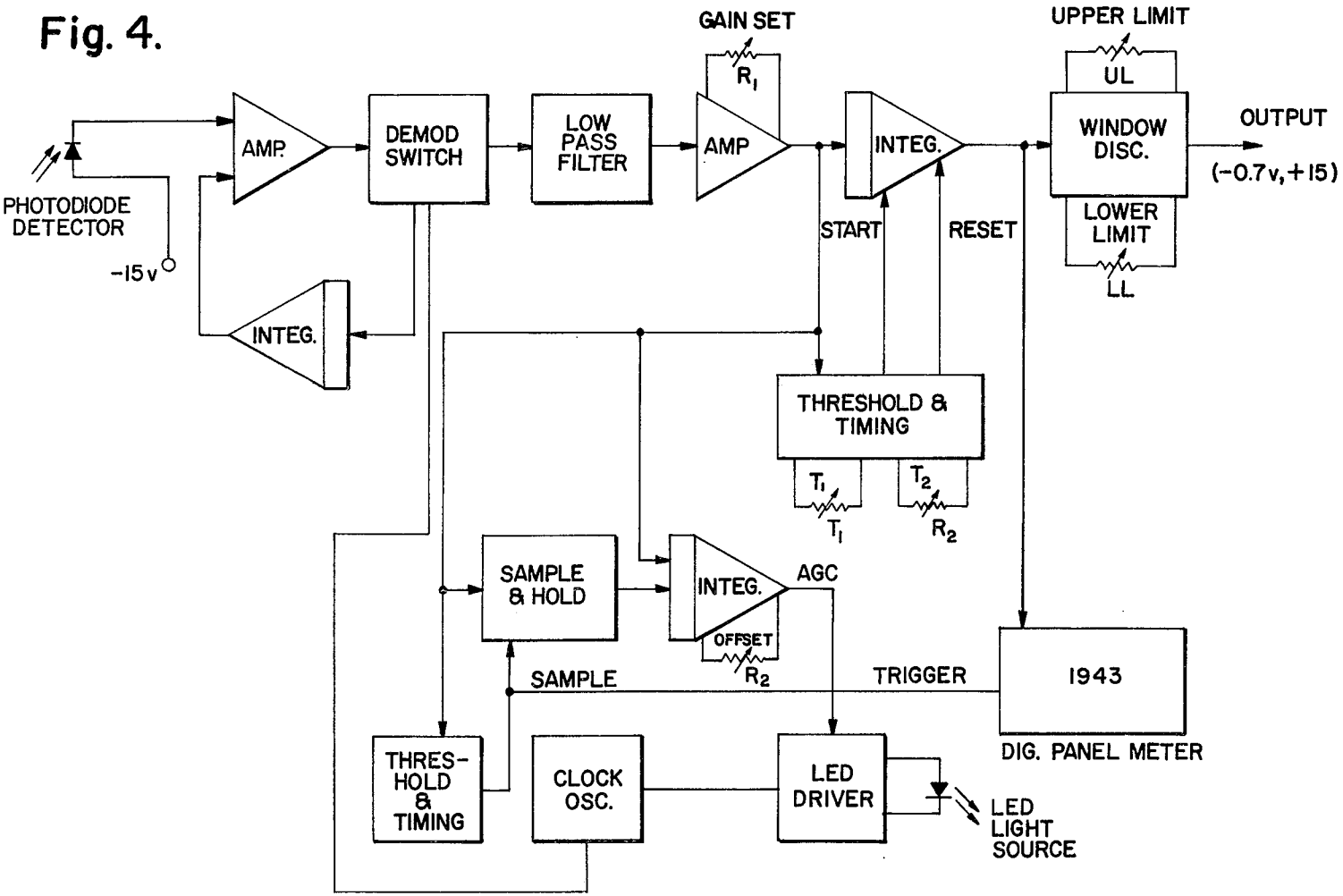
FIG. 4 is a system block diagram of the detector electronics of the present invention.
Figure 5:
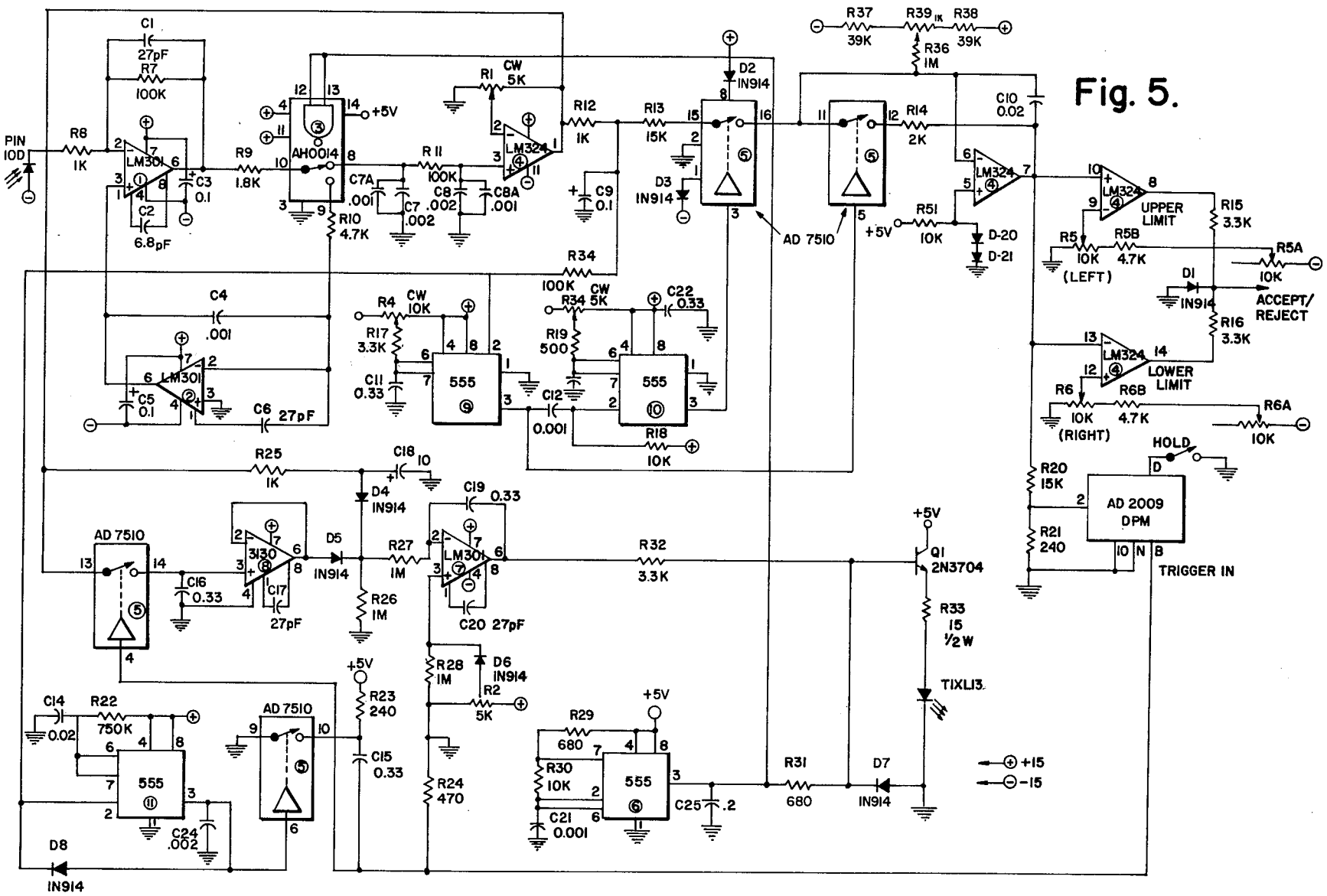
FIG. 5 is a schematic diagram of the detector circuit of the present invention.

Fastened below surface 22 is a light-emitting diode, LED, 88. The LED transmits infrared light, wavelength 0.93 micron. The infrared light is adapted to pass through variable iris 82, through glass 80, through a spectral filter and to the detector surface of the PIN 10 D photo-diode. The signal received is converted to a voltage by I.C. 1 in FIG. 5. Referring to FIGS. 4 and 5, the output of the LED is modulated by a stable clock oscillator, I.C. 6, to eliminate interference from ambient light levels. Light intensity correction is provided by automatic gain control, AGC I.C. 7, to compensate for changes caused by dirt or other contaminants in the area. Light intensity correction is made between inspection of the buttons and the new value of the intensity is stored and used for the subsequent inspection. The automatic correction is accomplished by the threshold timing and sample hold circuitry. To prevent correction of light intensity when a stream of buttons is passing through the beam and the output of I.C. 4, pin 1, decreased below 5 volts, the AGC path is through diode D5 instead of D4. The timer I.C. 11 is activated and causes a sample and hold pulse to generate. This voltage is buffered by I.C. 8 and serves as the AGC input through diode D5. The duration of the sample and hold pulse generated by I.C. 11 is set by time constant resistor 22 and is approximately 16 milliseconds.

The variable diameter iris 82 is used to control the diameter of the light beam to restrict its passage through an area only slightly larger than the center hole diameter of buttons being inspected. The aperture in the iris is set by the formula: $D=\frac{1}{2}$ hole spread$+3/2$ minimum diameter of the ligne size—maximum diameter of the ligne size—0.010. For example, the aperture for a ligne size 19 button having a minimum diameter of 0.474 and a maximum diameter of 0.482 inch is 0.328 inch.

A button passing through the beam and reducing the output of I.C. 4, pin 1, to below 5 volts also triggers pulse generator I.C. 9. I.C. 9 resets the signal integrator portion of I.C. 4 through a portion of FET switch I.C. 5. At the end of the reset interval I.C. 10 is triggered and sets the time length for integration of the signal. The integrated signal is held at pin 7 of I.C. 4 and serves as an input to a window discriminator. The period of I.C. 9 is controlled by the setting of $R_4$ and I.C. 10 is set by $R_3$. The setting of each $R_3$ and $R_4$ is a function of the ligne size of the buttons being inspected. A dual trace capability oscilliscope is used to set $R_3$ and $R_4$. The oscilliscope reads the output at pin 1 of I.C. 4 and the output at pin 3 of I.C. 10. $R_4$ is varied until the output of I.C. 10 symmetrically encompasses the center peak of the output of I.C. 4. $R_3$ is adjusted to vary the pulse width of the output of I.C. 10, typically it is less than 1 millisecond.

Potentiometers $R_5$ and $R_6$ located on the window discriminator portion of I.C. 4 are set as the upper and lower voltage limits to which the output voltage at pin 7 of I.C. 4 is compared. Potentiometers $R_5A$ and $R_6A$ are set first before adjusting $R_5$ and $R_6$. They are set by monitoring the voltage output at pin 7 of I.C. 4. $R_5A$ is adjusted until the voltage at pin 9 of I.C. 4 equals the voltage output at pin 7 of I.C. 4, and $R_6A$ is adjusted until the voltage at pin 12 of I.C. 4 is also equal to the output at pin 7 of I.C. 4. $R_5$ and $R_6$ are then set by testing a series of buttons known to be good and reading the value of the integration on the digital panel meter.

During inspection of a good button the voltage equivalent of integration as shown on the panel meter will be between the upper and lower acceptance limits as established by $R_5$ and $R_6$. For this condition the output of the detector electronics at the cathode of diode D1 will be a high positive voltage, approximately 15 volts. A button will be classified unacceptable if the voltage equivalent of integration, as shown on the panel meter, is above the upper limit or below the lower limit as set by $R_5$ and $R_6$. The output for an unacceptable button at the cathode of diode D1 will be a low voltage value, approximately $-0.7$ V.

Figure 7:
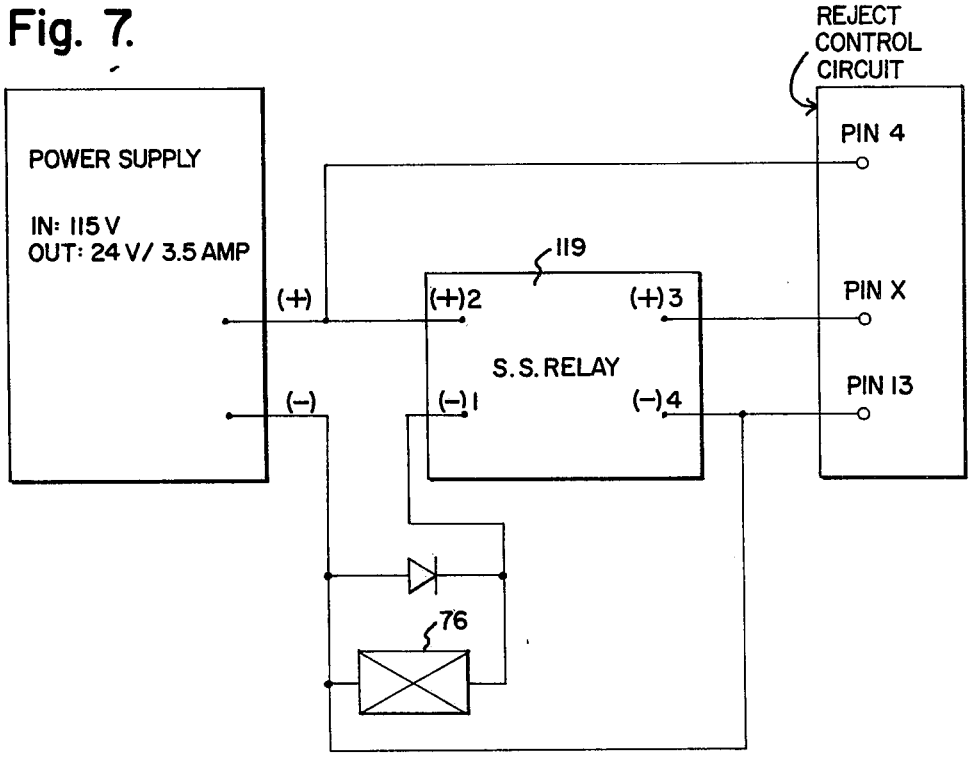
FIG. 7 is a schematic diagram of the circuit for the reject mechanism of the present invention.
Figure 1:
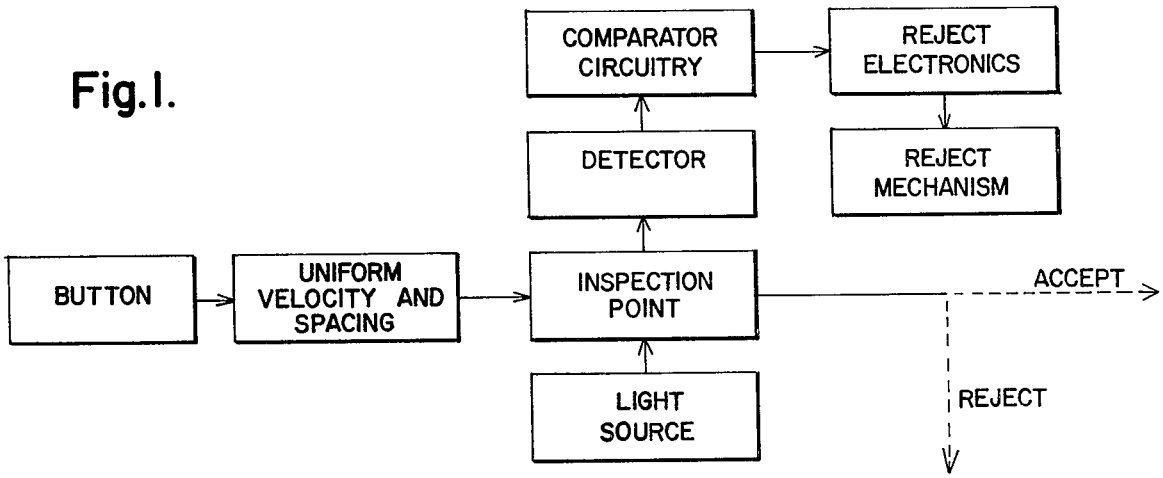
FIG. 1 is a block flow diagram of the method and apparatus of the present invention.
Figure 3:
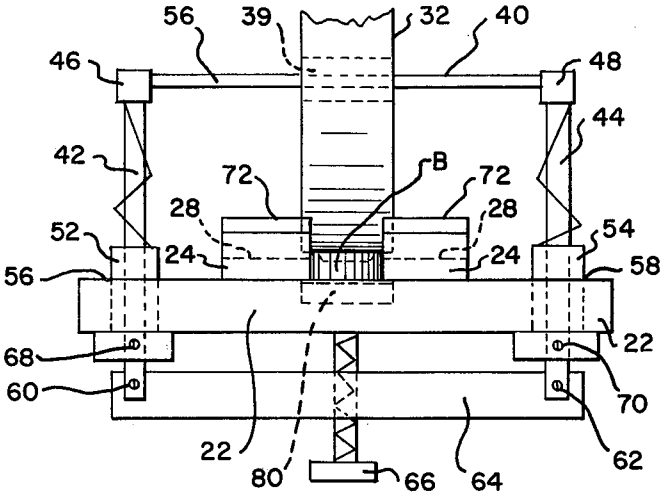
FIG. 3 is a front elevational view, partly in section, of the velocity control system.
Figure 6:
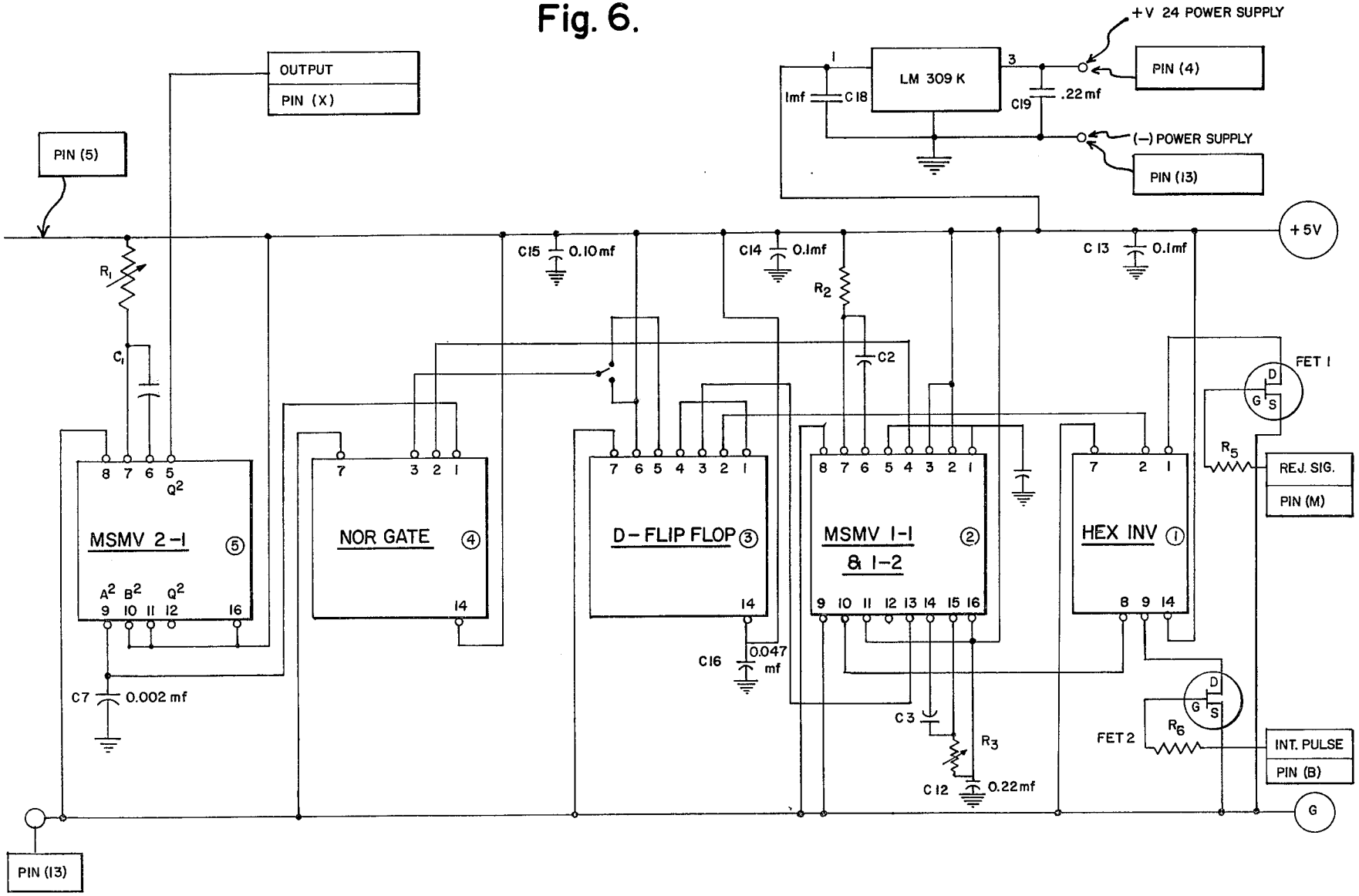
FIG. 6 is a schematic diagram of the reject circuit of the present invention.
Figure 8:
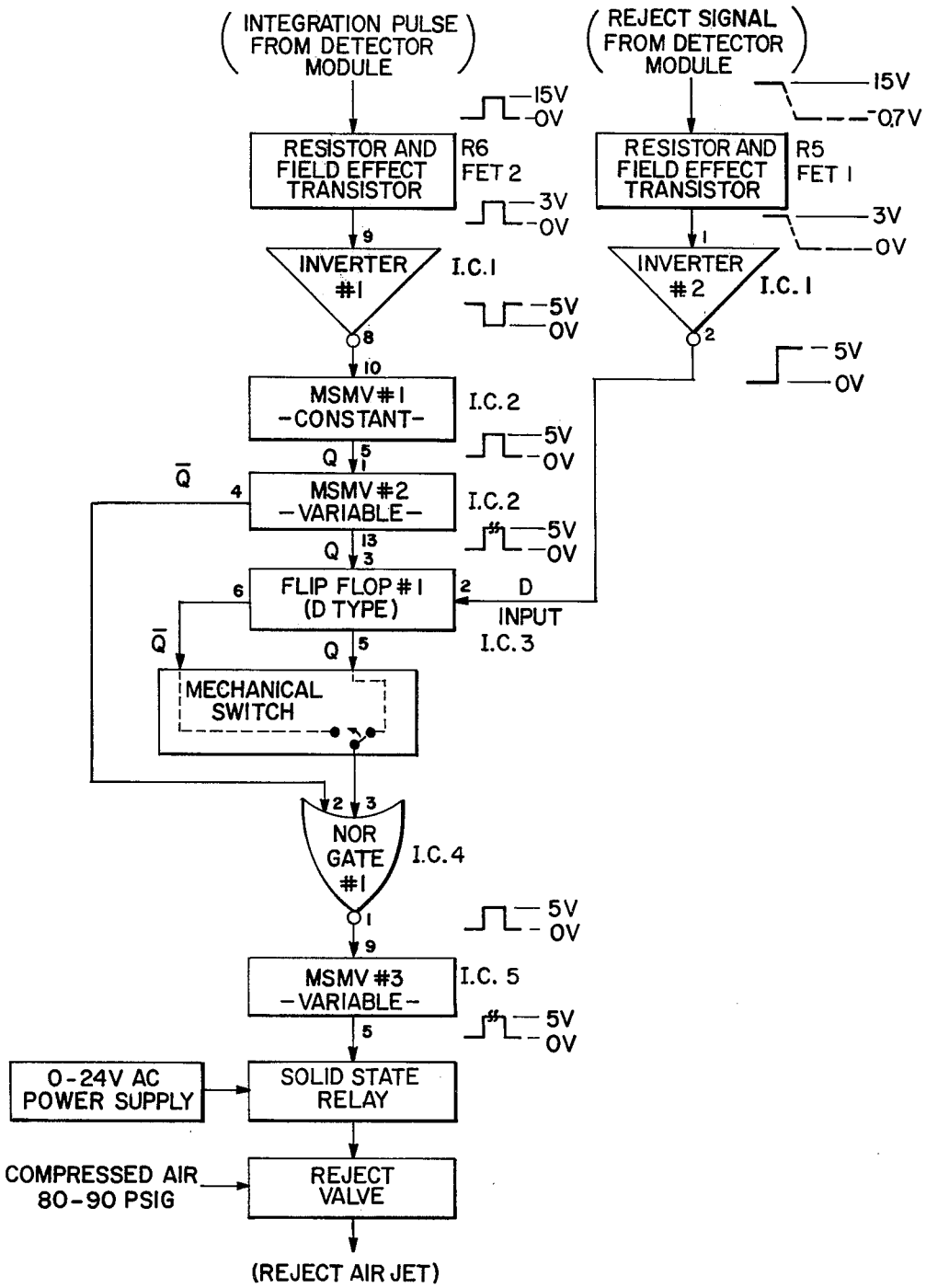
FIG. 8 is a schematic diagram of the digital control for the reject valve.
Figure 9:
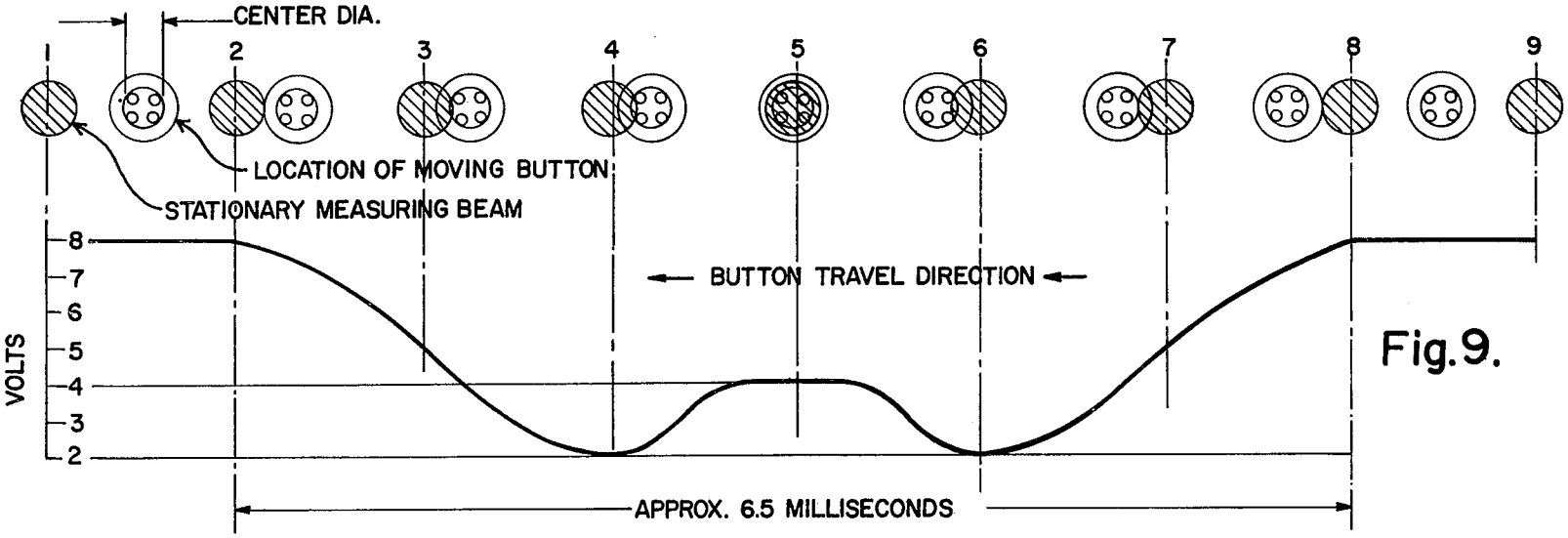
FIG. 9 is a schematic diagram illustrating how the waveform for a good button is generated.
Figure 10:
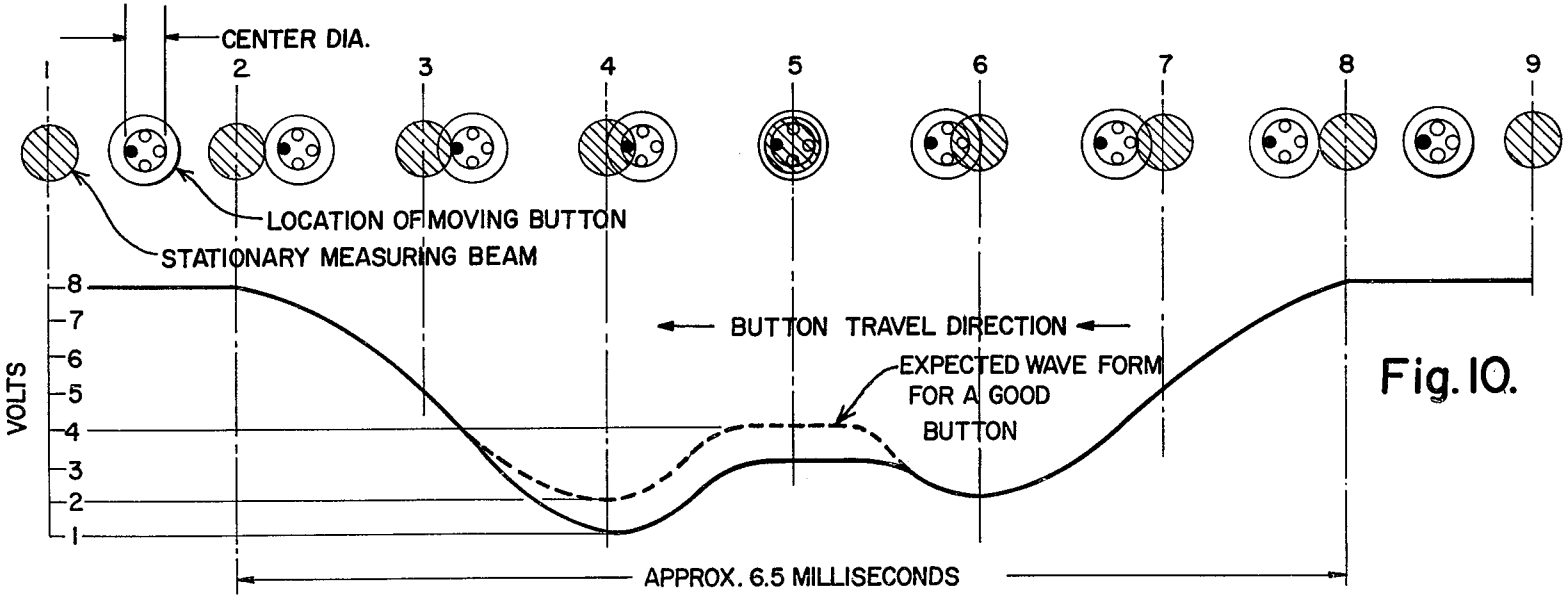
FIG. 10 is a schematic diagram illustrating how the waveform for a defective button is generated.

Referring to FIG. 6, the output of comparator I.C. 4 to diode D1 goes to pin M. The integration pulse at I.C. 4, pin 7 goes to pin B. A schematic of the digital control for the reject mechanism is fully set out in FIG. 7. The reject mechanism control circuit is shown in FIG. 6. Reject valve 76 is a fast acting solenoid air valve. As shown in FIG. 6, the input for NOR GATE 1 can either be the Q or $\overline{Q}$ from flop-flop 1. This gives the reject valve the capability to displace good or bad buttons.

In operation, several good buttons from the group to be tested would be selected to provide a good standard. The side guides 24 of the velocity control system are set by adding 0.01 inch to the average outside diameter of the particular ligne size being tested. Wheels 32 and 34 are then set so that a uniform velocity is imparted to the buttons. The height of the wheels 32 and 34 above the surface 22 of the velocity control system is approximately 0.008 inch less than the average thickness of the particular ligne size being tested. The variable diameter iris 82 is then set to restrict passage of the light beam through an area only slightly larger than the center hole diameter of the buttons being inspected in accordance with the formula on page 9.

The preselected good buttons are now fed by the feeder through the velocity control system 12 and past the LED 88. A dual trace oscilliscope is used to set $R_3$ and $R_4$ by reading the output at pin 1 of I.C. 4 and pin 3 of I.C. 10. $R_4$ is varied until the output of I.C. 10 symmetrically encompasses the center peak of the output of I.C. 4. $R_3$ is then adjusted to vary the pulse width of the output of I.C. 10. Potentiometers $R_5$ and $R_6$ are then set as the upper and lower voltage limits by varying the value of potentiometers $R_5A$ and $R_6A$, as described above. Once the foregoing have been set to accommodate the particular ligne size button to be tested, the buttons to be inspected are fed from the feeder, through the velocity control system and past the LED. Each button is inspected and, depending on the setting of the input for NOR GATE 1, the reject valve mechanism will either displace good or bad buttons. If buttons found to be bad are displaced, the good buttons will continue in a straight line to a collection point. It can be seen from the foregoing that the method and apparatus of the present invention provides an inexpensive, reliable and economical means of automatically inspecting buttons for various defects.

While the present invention is described as inspecting defects in the central hole portion of the button, it can be seen that after this inspection is carried out, iris 82 can be removed and the apparatus used to inspect for defects such as chips in the peripheral portion of the pre-inspected button. The inspection for chips would be carried out on the apparatus with the same method as described above, except without the iris to limit the diameter of the light beam; it would pass through the entire button.

While in compliance with the patent statutes we have set forth the best mode presently known to us to practice our invention, it is understood that our invention may otherwise be practiced within the scope of the following claims.

What is claimed:

1. An apparatus for automatically inspecting buttons and other transparent symmetrical objects comprising:

(a) velocity control means for imparting a uniform velocity and spacing the buttons, as they travel as a single line of buttons;

(b) light emitting means operably mounted with respect to said velocity control means for passing a light beam through each button;

(c) detector means for sensing said light beam after it passed through said button and developing a signal;

(d) first means for integrating said signal over a preselected time period to develop a value signal corresponding to the sum of the integration;

(e) comparator means for comparing the sum of integration with preset values and developing a plurality of electronic signals as a result of said comparison;

(f) second means for receiving said sum of integration and a selected one of said plurality of electronic signals and converting said sum and signals to an order signal; and (g) means responsive to said order signal for selectively determining the further path of travel of said buttons.

2. The apparatus for inspecting buttons and the like of claim 1 wherein said light emitting means includes a variable diameter iris adapted to restrict the diameter of the light beam emitted to pass through the central hole zone of the button being inspected.

3. The apparatus for inspecting buttons and the like of claim 1 wherein the velocity control means comprises:

(i) an inclined surface made from aluminum or the like;

(ii) side guides adjustably fixably attached to said inclined surface, said side guides adapted to receive said buttons and act as a conduit therefor over a portion of the length of said inclined surface;

(iii) transparent insert means within said inclined surface and beneath said side guides;

(iv) a plurality of velocity control wheels adjustably fixably mounted above said inclined surface, said wheels adapted to frictionally engage said buttons and impart a uniform velocity thereto; and (v) motor means for driving each of said velocity control wheels at a preset constant speed.

4. The apparatus for inspecting buttons and the like of claim 3 wherein a cover means spans the width of said side guides upstream said velocity control wheels.

5. The apparatus for inspecting buttons and the like of claim 2, wherein the means for comparing said integrated pulse and said preset values includes potentiometers located on a window discriminator portion thereof for presetting the voltage limits to which the sum of integration is compared.

6. An apparatus for automatically inspecting buttons and other transparent symmetrical objects comprising:

(a) an inclined velocity control surface adapted to receive said buttons, said velocity control having a transparent insert extending the length thereof, said transparent insert providing a low friction path for said button over said control surface, (b) side guide means adjustably fixably mounted on said control surface, said guide means adapted to restrict the lateral motion of said buttons on said surface, said side guides extending substantially the entire length of said control surface, (c) a first velocity control wheel adjustably fixably mounted above said control surface and said side guides driven at a constant velocity by motor means, said first wheel means adapted to engage said buttons and impart a uniform velocity to each said button passing in contact therewith, (d) a second velocity control wheel adjustably fixably mounted above said control surface and said side guides driven at a constant velocity by motor means, said second wheel means adapted to engage said buttons and impart a uniform velocity to each said button passing in contact therewith, (e) cover means spanning the width of said side guides to restrict vertical movement of said buttons, said cover means selectively spaced on the length of said guide means to avoid interference with said control wheels, (f) light emitting means operably mounted below said control surface, said light means adapted to pass a beam of light through said transparent insert and through said buttons, (g) electronic detector-sensor means adapted to receive said light beam and convert it to an electronic signal, (h) first electronic means for integrating said signal over a preset period of time, (i) electronic comparator means for comparing the sum of integration of said signal with preset voltage values, said comparator means issuing a plurality of electronic signals adapted to correspond to the comparison results, (j) second electronic means adapted to receive said sum of integration and a selected one of said plurality of signals and convert said sum and said signals to an order signal, and (k) reject means responsive to said order signal for selectively determining the further path of travel of said buttons.

7. The apparatus for inspecting buttons and the like of claim 6 including a variable diameter iris operably connected to said light source for controlling the diameter of said light beam to limit said light beam to the central hole portion of said buttons.

8. The apparatus for inspecting buttons and the like of claim 6 including switch means operably connected to said second electronic means, said switch means adapted to make said reject means selectively responsive to a selected order signal.

9. The apparatus for inspecting buttons and the like of claim 8 including a modulator and automatic gain control the sum voltage of which drive said light source.

10. The apparatus for inspecting buttons and the like of claim 9 including a pulse generator operably connected to said detector-sensor and said automatic gain control, said pulse generator adapted to lock out said automatic gain control when a button passes between said light source and said detector-sensor.

11. The apparatus for inspecting buttons and the like of claim 10 wherein the electronic means for comparing said integrated pulse and said preset values includes potentiometers located on a window discriminator portion thereof for presetting the upper and lower voltage limits to which the value of the sum of integration is compared.

12. The apparatus for inspecting buttons and the like of claim 10 wherein the reject mechanism includes a solenoid air valve adapted to selectively displace selected buttons from their path of travel.

13. The apparatus for inspecting buttons and the like of claim 12 wherein said second velocity control wheel is located approximately 6 inches downstream of said first velocity control wheel.

14. The apparatus for inspecting buttons and the like of claim 13 wherein said first velocity control wheel is driven 400 to 500 r.p.m. and said second velocity control wheel is driven at 500 to 600 r.p.m.

15. The apparatus for inspecting buttons and the like of claim 14 wherein said inclined velocity control surface is inclined at an angle of approximately 35°–50°.

16. A method of automatically inspecting buttons and other transparent symmetrical objects comprising the steps of:

(a) imparting a uniform velocity to said buttons,
(b) passing a light beam through said buttons,
(c) analyzing the light beam which passed through said buttons,
(d) comparing the results of the light beam analysis to preset values; and
(e) generating a plurality of signals as a result of said comparison, said signals adapted to operate a reject mechanism adapted to select one of said signals to selectively divert the path of travel of the plurality of buttons which caused the generation of the selected signal.

17. The method of automatically inspecting buttons and the like of claim 16 wherein said light beam is passed through the central hole portion of said button.

18. A method of automatically inspecting buttons and other transparent symmetrical objects comprising the steps of:

(a) imparting a uniform velocity to said buttons,
(b) passing a light beam through the central hole portion of said buttons,
(c) electronically analyzing the light beam which passed through the central portion of said buttons,
(d) comparing the electronic results of said analysis to preset values,
(e) generating a numerical or digital display for good or bad buttons,
(f) generating a plurality of electronic signals as a result of said comparison, said signals adapted to operate a reject mechanism adapted to select one of said signals to direct the path of travel of the plurality of buttons which caused the generation of the selected signal,
(g) selecting said buttons which compared favorably with said preset values and imparting a uniform velocity thereto,
(h) passing a light beam through the entirety of the buttons so selected,
(i) electronically analyzing the light beam which passed through said selected buttons,
(j) comparing the electronic results of said analysis to preset values; and
(k) generating a plurality of electronic signals as a result of said comparison, said signals adapted to operate a reject mechanism adapted to select one of said signals and displace the path of travel of the plurality of buttons which caused the generation of the selected signal.

* * * * *